US007124530B1

(12) United States Patent
Clark

(10) Patent No.: US 7,124,530 B1
(45) Date of Patent: Oct. 24, 2006

(54) GUN HOLDER APPARATUS

(76) Inventor: Steve Clark, 15000 Black Oak Dr., Smithville, MO (US) 64089

( * ) Notice: Subject to any disclaimer, the term of this patent is extended or adjusted under 35 U.S.C. 154(b) by 0 days.

(21) Appl. No.: 11/177,545

(22) Filed: Jul. 8, 2005

(51) Int. Cl.
*F41A 23/04* (2006.01)

(52) U.S. Cl. ..... 42/94; 42/90

(58) Field of Classification Search ..... 42/94, 42/93; 211/64; 248/530, 532; 135/76, 81, 135/118; D22/417, 552
See application file for complete search history.

(56) References Cited

U.S. PATENT DOCUMENTS 3,007,581 A 11/1961 Moore
3,584,821 A * 6/1971 Glebe ..... 248/156
3,952,878 A 4/1976 Gorham
4,089,423 A * 5/1978 Gorham et al. ..... 211/64
4,144,971 A 3/1979 Balibrea
4,271,969 A * 6/1981 Gnesa ..... 211/64
5,680,939 A 10/1997 Oliver
5,749,386 A * 5/1998 Samuel, Jr. ..... 135/16
5,819,462 A 10/1998 Dockery
5,913,667 A * 6/1999 Smilee ..... 42/94
6,035,572 A 3/2000 Goode, Jr.
6,863,187 B1 3/2005 Robertson
6,935,065 B1 * 8/2005 Oliver ..... 42/94

* cited by examiner

*Primary Examiner*—Michael J. Carbone
*Assistant Examiner*—Stewart T. Knox
(74) *Attorney, Agent, or Firm*—Shughart Thomson & Kilroy PC; Richard P. Stitt

(57) ABSTRACT

A gun holder for a shotgun or rifle is provided which permits accommodation of shotguns or rifles of various lengths and including single barrel, side-by-side and over-and-under shotguns and permits the positioning of the shotgun at various heights along the vertical shaft of the support member to accommodate various water depths of ponds or lakes.

11 Claims, 5 Drawing Sheets

GUN HOLDER APPARATUS

BACKGROUND OF THE INVENTION

In the course of hunting for game, and in particular waterfowl, the hunter will remain in a particular location for long periods of time. During these periods of waiting for the game or birds to appear, it is unnecessary to actually hold the gun and have it at the ready. Rather, the gun may be conveniently placed nearby the hunter while waiting for game to appear or while the hunter is engaged in other activities such as manipulating bird calls, placing decoys. While a hunter on dry land may take advantage of several options and devices for safely holding a shotgun or rifle during intervals of non-use, the waterfowl hunter often will not have the luxury of being adjacent to dry land on which the gun may be positioned. Typically, hunting for ducks and other waterfowl will occur in damp, swampy land, or the hunter may actually wear waders and be in knee or waist deep water at the edge of a pond or lake. In such an instance, the shotgun cannot be set aside as the water, or at least swampy, damp ground would damage the shotgun. In the case of a hunter who has waded into the edge of a pond or lake, the depth of water in which the hunter is positioned will vary in depth. Due to this variance in depth, the hunter cannot count upon using a holder of a fixed or limited height as the depth of water will vary and the height of the gun support relative to the holder bottom must be varied accordingly with the water depth. In addition it will be appreciated that as the water depth varies, so must the length of gun holder that is to be extending below the gun be varied to account for the variations in water depth encountered by the hunter.

A number of prior art devices have been developed to assist with this problem. U.S. Pat. No. 4,144,971 to Balibrea teaches a gun caddy or gun holder which may be inserted into the ground by use of a stake 18, 20 and which provides an immobile base member 16 which is attached to shaft member 12 having a grip member 14 for support of the barrel. The Balibrea device would not be useful in marshy areas or in water flooded areas as the securing of the Balibrea device within the ground by stakes 18 and 20 would place the gun stock within the water or dangerously close to the water in the marshy ground, therefore, the Balibrea device lacks the necessary adjustability.

The device of Oliver, U.S. Pat. No. 5,680,939 presents a ground engageable gun support having parallel vertical shafts which are slidably connected by use of stabilizer brackets 11 having wing nuts 12 therein to secure vertical shafts in relative position to one another. While Oliver provides a means of adjusting the height of the gun above the surface into which the spiked end is to be inserted, the device is bulky and requires that two hands be available to create the height adjustment between the vertical shafts.

The need for two hands to effect adjustment leaves no hands available to hold the gun out of the water—a substantial limitation.

Another gun support device is shown in U.S. Pat. No. 5,819,462 to Dockery. The Dockery gun holder does not allow for adjustment of the height of the gun support above the ground. The height of the gun support is determined by the point of contact of arm 38 with protrusion 34 of the Dockery device. Therefore, the location of protrusion 34 during the manufacturing process will dictate the height of the gun above the ground in the Dockery device. Thus, the Dockery device is not suitable for use in situations where variable depths of water will be encountered.

Another gun rest is encountered in U.S. Pat. No. 6,035,572 to Goode, Jr. The device of Goode, Jr. presents a gun support 28 which is fixed to shaft 22 by welding or other fastening means. Therefore, no adjustment is made for the height of gun support 28 above the ground or marshy water. Further, it will be appreciated that cross bar 34 of the Goode device is fixed at a certain height leaving a specific amount of shaft 33 which can be introduced into the ground until it is stopped from further movement by cross bar 34. This would limit the utility of the Goode device in marshy areas or water at variable depth. As stated in the description of FIG. 4, it is the object of the Goode device to allow the ground engaging member 33a to be limited in the amount of entry it will make into the ground thus making it easy to withdraw as the user walks and repositions member 33a to engage the bottom surface. Therefore, the device of Goode is the antithesis of a stable support for holding a gun.

Therefore, it would be a benefit to bird and waterfowl hunters if a gun holder were available that is collapsible and easily portable and yet easily adjustable in the length of the upright and adjustable in the positioning of the base of the gun holder so variations in water depth or the depth of the marshy ground before solid ground is reached may be accounted for in the use of the gun holder or gun support device.

SUMMARY OF THE INVENTION

The present invention generally comprises a gun holder having an extendable or telescoping upright and having an upper end of the upright piece adapted for capture of a gun barrel therein while also having a gun stock support for the stock of the gun the location of which is adjustable along the length of the upright. The location of the gun stock support to provide a sufficient length of the upright below the gunstock support to securely mount the upright within the varying depth of a pond or lake or marshy ground while enabling the gunstock support portion to be positioned above the water or marsh and while providing the adjustment of the distance between the gunstock support and the barrel holder portion so the barrel holder portion will capture the barrel and not be obstructed by the shotgun magazine tube or of the shotgun.

It is an object of the present invention to provide a variable height support for a shotgun for use in swampy or marshy or watery environments.

It is a further object of the present invention to provide a support of adjustable length for a shotgun, the length of adjustment being the distance between the gun stock support and the gun barrel support.

It is yet another object of the present invention to provide a gun support for watery or marshy areas that allows the gun stock support to be adjusted to place the gun stock support above the height of water at various depths.

It is yet another object of the present invention to provide a gun holder which may be inserted into marshy ground at various depths or into a lake or pond bed to various depths while adjusting the height of the support of the gun to a distance of convenience for the hunter or to a distance above the depth of the water of a lake or pond.

DESCRIPTION OF THE PREFERRED EMBODIMENT

Figure 1:
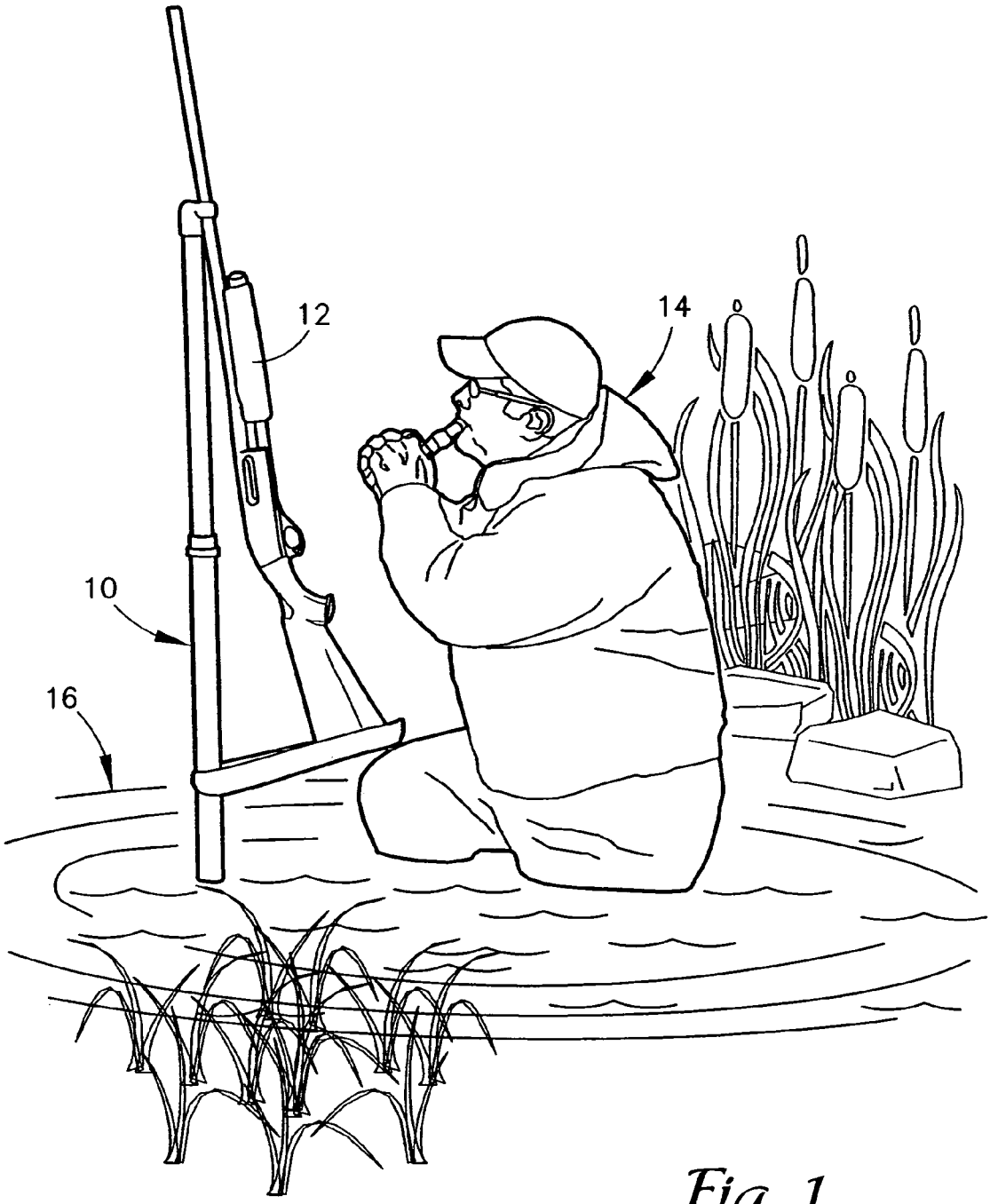
FIG. 1 shows an embodiment of gun holder 10 in use during hunting in a pond, marsh or swamp environment.

Referring now to FIG. 1, the gun holder 10 of the present invention is shown positioned with a shotgun 12 supported thereon. The holder 10 and shotgun 12 are adjacent a hunter 14 who is hunting within the shallow water of a pond or a lake 16. It will be appreciated from FIG. 1 that shotgun 12 is held above the surface of pond or lake 16 by gun holder 10, and that shotgun 12 is ready for immediate use by hunter 14.

Figure 2:
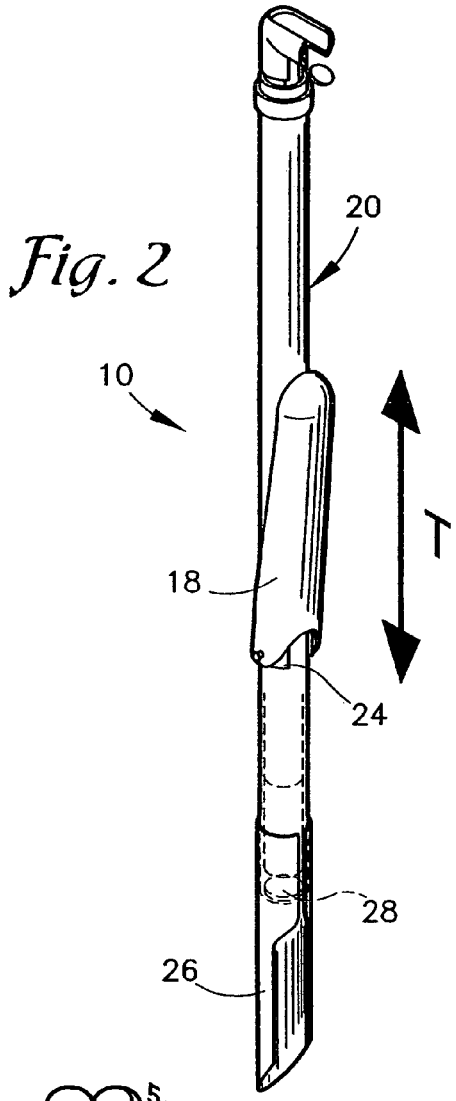
FIG. 2 is a perspective view showing an embodiment of gun holder 10 of the present invention in the collapsed position and with the gun stock support closed.
Figure 3:
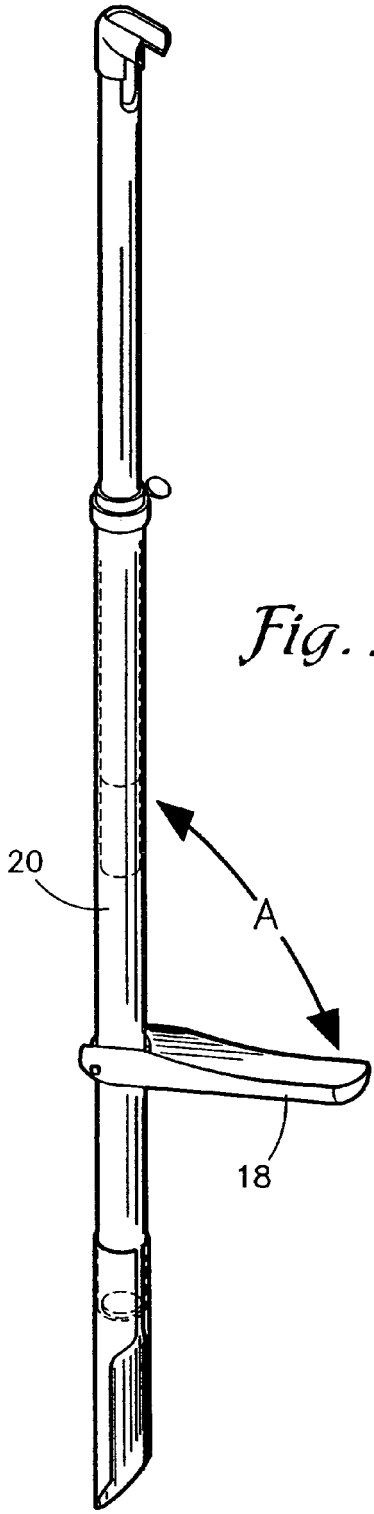
FIG. 3 is a perspective view showing an embodiment of gun holder 10 of the present invention in the extended position and with the gun stock support open.
Figure 4:
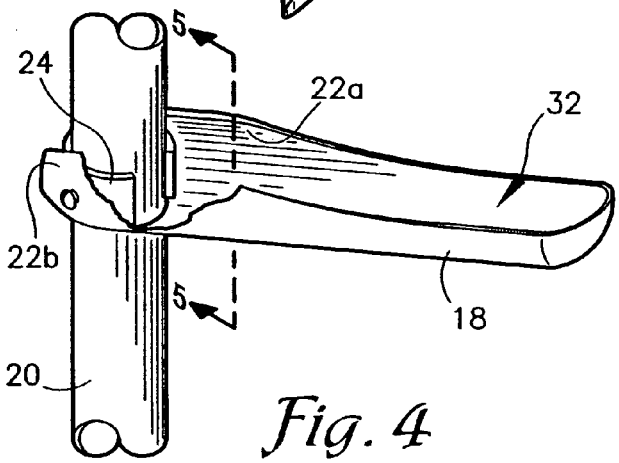
FIG. 4 is a perspective view showing an embodiment of the gun stock support of the present invention in the open position; and having a portion of the support cut away to reveal the curvature of the gun stock support.

Referring now to FIGS. 2–4, the means of operating shotgun holder 10 will be described. First referring to FIG. 2, gun holder 10 is shown with gun stock support 18 in a first or upward position which places gun stock support 18 in a generally co-axial position with upright member 20 of gun holder 10. When gun stock support 18 is in the co-axial position with upright member 20, gun stock support 18 may be moved along the length of upright member 20 in the directions shown by arrow T. This movement allows the position of gun stock support 18 to be varied along the length of upright member 20 to the extent that obstructions are not introduced to the movement of gun stock support 18. Variations on the construction of shotgun holder 10 will be discussed hereinafter which describe means of avoiding obstructing the movement of gun stock support 18.

Referring now to FIG. 3, gun stock support 18 is shown in a second position in which gun stock support 18 is generally orthogonal to upright member 20. To achieve the position of gun stock support 18 shown in FIG. 3, gun stock support 18 is pivotally moved in the direction shown by arrow A to move gun stock support 18 out of a first position which is generally co-axial with upright member 20 (FIG. 2) and into a second position which is generally orthogonal to upright member 20 (FIG. 3). Gun stock support 18 is moved into the open or downward or second position shown in FIG. 3 when the hunter has determined the proper position for gun stock support 18 along the height of upright member 20-and wishes to lock gun stock support 18 into position. Alternatively, those skilled in the art will appreciate that upon the initial insertion of shotgun holder 10 into a pond or a marshy area, gun stock support 18 will be in the closed position as shown in FIG. 2 so that it may be moved as far upwardly along upright member 20 as is possible to allow hunter 14 (FIG. 1) to insert end piece 26 of upright member 20 into a marsh or a pond bed while avoiding the need to be concerned that gun stock support 18 will initially be positioned under water and will need to be retrieved from such a position.

Referring now to FIG. 4, the means of locking gun stock support 18 into position along the height of upright member 20 will be described. In FIG. 4, gun stock support 18 is shown in the open or lowered or orthogonal position with respect to upright member 20. Gun stock support 18 is most conveniently formed from a length of PVC pipe or other plastic tubing having a diameter similar to or slightly smaller than upright member 20. This similarity of diameter permits gun stock support 18 to be positioned co-axially with respect to upright member 20 when support 18 is placed in the upright position of FIG. 2. When support 18 is placed in the lowered or orthogonal position with respect to upright member 20, arms 22*a* of stock support 18 compress against upright member 20 and prevent of gun stock support 18 and collar 24 from up and down movement along upright member 20 in the direction of T. In addition gun stock support 18 is pressed against upright member 20 and further presents a frictional resistance to movement of gun stock support 18 and collar 24 upwardly or downwardly with respect to upright member 20. In this manner, the configuration of stock support 18 operates to lock stock support 18 in place with respect to upright member 20 when stock support 18 is placed in the lowered or orthogonal position with respect to upright member 20. The compressive action provided by stock support 18 results from the rigidity of the materials used to produce stock support 18. In a preferred embodiment of the present invention, PVC tubing or other tubular plastic is shaped to create gun stock support 18 by cutting away from one-half to three-quarters of the PVC pipe along the longitudinal axis of the pipe section to provide the cup holder section 32 in which shotgun 12 (FIG. 1) can rest. The shaping also provides arms 22*a, b* which have sufficient distance therebetween to permit movement of stock support 18 between the upright and lowered position and while providing sufficient compressive force when in the downward or orthogonal position to lock gun stock support 18 into place with respect to upright member 20. It will be appreciated by those skilled in the art that the selection of the material used to form gun stock support 18 provides the user of gun holder 10 a degree of flexibility in adjusting the amount of compression provided by stock support 18. Also, the user of holder 10 can trim back the length of arms 22*a, b* to slightly reduce the amount of compression provided by arms 22*a, b* against upright member 20 where a light weight gun is used, or where the holder is intended to be used for fishing equipment rather than guns, and where the weight of the fishing equipment would be substantially less than that of a shotgun. Also the reduction in length of arms 22*a, b* will reduce the amount of force needed to press gun stock support 18 downwardly into the lowered position from the upward position shown in FIG. 2.

Figures 5, 6:
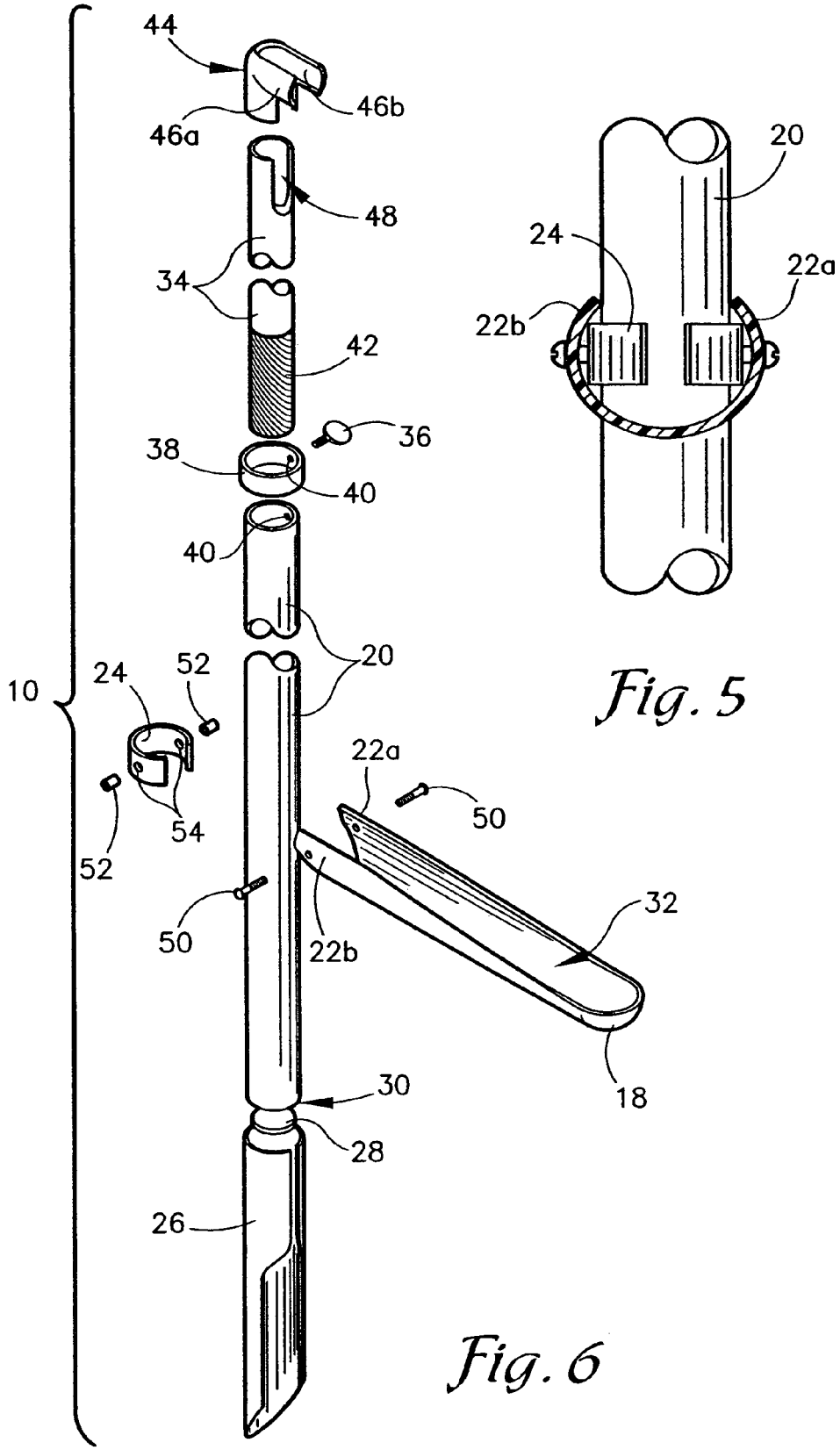
FIG. 5 is a cross section view taken along line 5—5 of FIG. 4 and showing the compression of the curved sides of the gun stock support against the upright said compressive face serving to lock said gun stock support in position and said upright 20.
FIG. 6 is an exploded view of the embodiment of the gun holder 10 shown in FIGS. 1–3.
Figure 7:
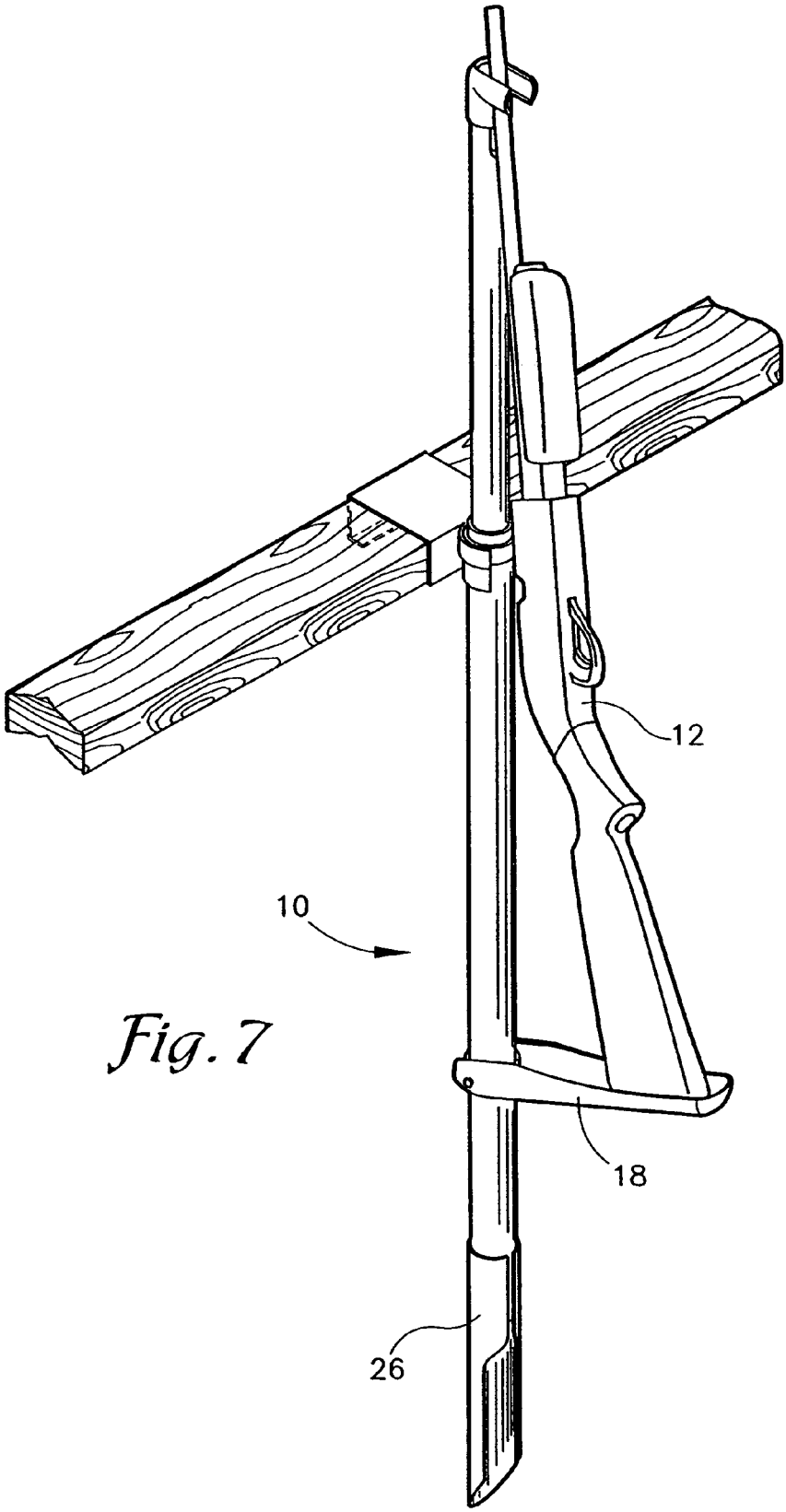
FIG. 7 is a perspective view showing an embodiment of the gun holder of the present invention hanging from a fence rail, water blind or, alternatively, from a 2×4 board with the gun stock support in the extended position and a shot gun supported therein.

Referring now to FIG. 5, the configuration of gun stock support 18 in cross sectional view taken along line 5—5 of FIG. 4 is shown. In this cross-section view, the general C-shape of gun stock support 18 is shown, and the compressive contact of arms 22*a, b* against upright member 20 is shown.

Referring again to FIG. 2, pointed end piece 26 is shown attached to upright member 20. End piece 26 is provided to allow ease of insertion of holder 10 into dirt, or sand or mud. In use, the user simply grasps upright member 20 of holder 10 and positions pointed end piece 26 at the location in which holder 10 is to be inserted into the ground. The user then presses downwardly on upright member 20 in the direction shown by the arrow T to force holder 10 into the ground to a sufficient depth to provide stability to upright member 20 and to support the gun 12 that is to be placed thereon.

Referring now to FIGS. 2 and 6, end cap 28 is shown which is inserted into bottom or lower end 30 of upright member 20. It will be appreciated by those skilled in the art that as upright member 20 is a telescoping unit that it is hollow and, therefore, without the lower end 30 of upright member 20 being obstructed in some fashion that the insertion of pointed end 26 into the ground or mud or dirt would force mud or earth into upright member 20. End cap 28 inserted into lower end 30 of upright member 20 prevents such collection of mud or dirt in upright member 20.

Still referring to FIG. 6, the assembly of the components in an exploded view of FIG. 6 will now be described. Gun holder 10 is comprised of a central shaft 20 having a telescoping shaft member 34 fitted therein. The extension of telescoping shaft member 34 with respect to upright member 20 can be fixed through use of wing nut 36 which is screwed in through screw void 40 in wing nut collar 38 to thereby provide a compressive locking force against telescoping shaft member 34 to thereby fix the amount of extension of telescoping shaft member 34 extending from upright member 20. During the course of extending telescoping shaft member 34 from upright member 20, the user will be warned of the nearing of the end of telescoping shaft member 34 by the appearance of warning area 42 which is simply a portion of telescoping shaft member 34 which has been marked in some differentiating fashion such as a different color or striping, etc., to quickly warn the user that telescoping shaft member 34 is nearing complete removal from upright member 20.

At the upper end of telescoping shaft member 34 is gun barrel holder 44 which is equipped with opposed flanges 46*a, b* which serve to capture the barrel of the shotgun 12 within barrel holder 44. A void 48 is presented within telescoping shaft member 34 just below barrel holder 44 to allow the barrel of shotgun 12 to become fitted deeply within opposed flanges 46*a* b. At the opposite end of gun holder 10 from barrel holder 44 is pointed end piece 26 which is fitted onto upright member 20. As previously described, the open end of upright member 20 is closed by the insertion of end cap 28 into bottom lower end 30 of upright member 20.

Gun stock support 18 is attached to upright member 20 by collar 24. The connection between gun stock support 18 and collar 24 is provided by screws or fasteners 50 which pass through bushings 52 inserted into voids 54 within collar 24.

When gun stock support 18 is in the upward or coaxially position with respect to upright member 20, arms 22*a, b* provide no compression against upright member 20 and gun stock support 18 may be slidably moved along the length of upright member 20 as it rides on collar 24 which is positioned around upright member 20. Once collar 24 has been placed along the length of upright member 20 where it is desired to fix gun stock support 18 into position, the user lowers gun stock support 18 into its lowered or orthogonal position to effect compression of arms 22*a, b* against upright member 20 thereby securing gun stock support 18 into a fixed position along the length of upright member 20.

Figure 8:
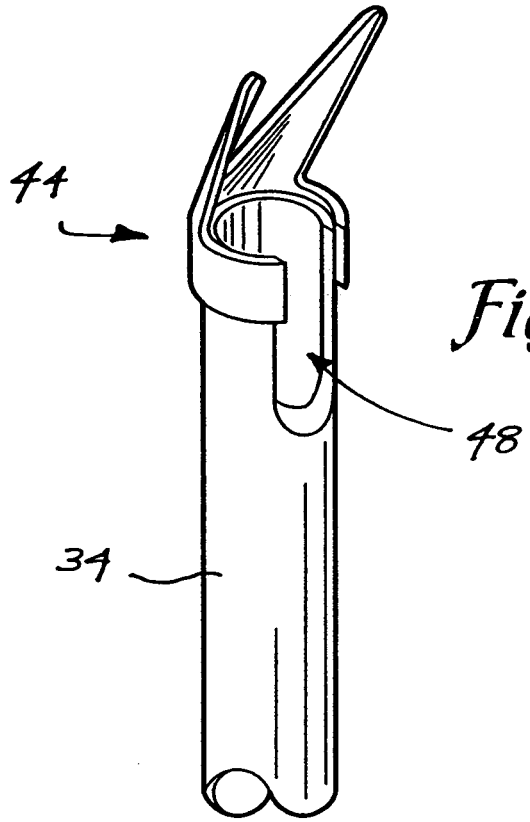
FIG. 8 shows an alternate embodiment of gun barrel holder 44.
Figure 9:
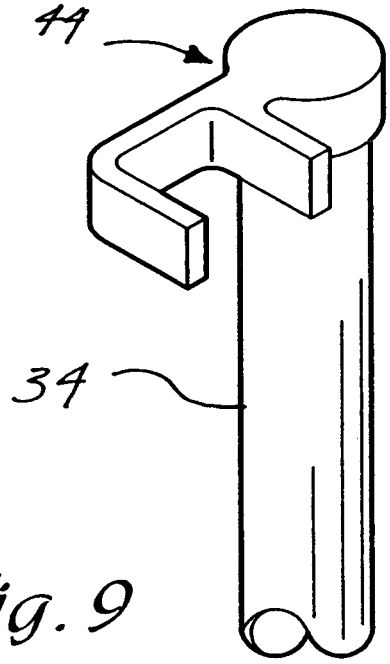
FIG. 9 shows another alternate embodiment of gun barrel holder 44.

FIGS. 8 and 9 show alternative embodiments of gun barrel holder 44 which may be instead of the gun barrel holder B that is shown in FIGS. 1–3, 6 and 7. It will be appreciated by those skilled in the art that gun barrel holder 44 can take many forms which can be used successfully with the present invention.

It will be appreciated that to better blend the gun holder with the surrounding landscape and foliage, the exterior of the device may be painted or provided with a paint and finish pattern such as a camouflage pattern and coloring.

Certain changes may be made in embodying the above invention and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive gun holder apparatus is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention, which, as a matter of language, might be said to fall therebetween.

The invention claimed is:

1. A gun holder apparatus comprising:
   - a generally upright member comprising at least two telescoping sections said member having an upper end and a lower end,
   - a pointed end piece connected to said lower end for inserting said member into the earth,
   - a gun barrel rest extending from said upper end said rest having first and second spaced apart flanges for receiving a gun barrel therebetween,
   - a collar slidably mounted on said member for selectable re-positioning along said member, and
   - a gun stock support having a generally C-shaped cross-section comprising a first and a second opposed arms said support pivotally connected to said collar for movement between a first position generally co-axial with said member and a second position generally orthogonal to said member said second position securing said support at a selected collar position by a compression fit of said opposed arms against said member as said support is pivoted into said second position.

2. The gun holder as claimed in claim 1 a screw for securing said telescoping sections in position relative to one another.

3. The gun holder as claimed in claim 1 wherein said first and second spaced apart flanges are sufficiently spaced for receiving a single barrel or side-by-side shot gun barrel or over/under barrel therein.

4. The gun holder as claimed in claim 1 wherein said lower end is sealed to prevent entry of material therein.

5. The gun holder as claimed in claim 1 wherein said gun holder exterior is comprised of a camouflaged finish color and/or finish pattern.

6. The gun holder as claimed in claim 1 wherein said gun stock support is formed from a resilient plastic tube material for providing a compressive force against said generally upright member as said support is pivoted into said second position.

7. A gun holder apparatus comprising:
   - a generally upright member comprising an upper end and a lower end, a pointed end piece connected to said lower end for inserting said member into the earth, a gun barrel rest extending from said upper end said rest having first and second spaced apart flanges for receiving a gun barrel therebetween, a collar slidably mounted on said member for selectable re-positioning along said member, and a gun stock support having a generally C-shaped cross-section comprising a first and a second opposed arms said support pivotally connected to said collar for movement between a first position generally co-axial with said member and a second position generally orthogonal to said member said second position securing said support at a selected collar position by a compression fit of said opposed arms against said member as said support is pivoted into said second position.

8. The gun holder as claimed in claim 7 wherein said first and second spaced apart flanges are sufficiently spaced for receiving a single barrel or side-by-side shot gun barrel or over/under barrel therein.

9. The gun holder as claimed in claim 7 wherein said lower end is sealed to prevent entry of material therein.

10. The gun holder as claimed in claim 7 wherein said gun holder exterior is comprised of a camouflaged finish color and/or finish pattern.

11. The gun holder as claimed in claim 7 wherein said gun stock support is formed from a resilient plastic tube material for providing a compressive force against said generally upright member as said support is pivoted into said second position.

* * * * *